US010144992B2

(12) United States Patent
Zhang et al.

(10) Patent No.: US 10,144,992 B2
(45) Date of Patent: Dec. 4, 2018

(54) AMORPHOUS ALLOY AND METHOD FOR PREPARING THE SAME

(71) Applicant: BYD Company Limited, Shenzhen (CN)

(72) Inventors: Faliang Zhang, Shenzhen (CN); Qing Gong, Shenzhen (CN)

(73) Assignee: BYD COMPANY LIMITED, Shenzhen, Guangdong (CN)

( * ) Notice: Subject to any disclaimer, the term of this patent is extended or adjusted under 35 U.S.C. 154(b) by 534 days.

(21) Appl. No.: 14/655,578

(22) PCT Filed: Dec. 24, 2013

(86) PCT No.: PCT/CN2013/090294

§ 371 (c)(1),
(2) Date: Jun. 25, 2015

(87) PCT Pub. No.: WO2014/101744

PCT Pub. Date: Jul. 3, 2014

(65) Prior Publication Data

US 2015/0345000 A1 Dec. 3, 2015

(30) Foreign Application Priority Data

Dec. 31, 2012 (CN) ..... 2012 1 0592381

(51) Int. Cl.
*C22C 45/10* (2006.01)
*C22C 1/02* (2006.01)
(Continued)

(52) U.S. Cl.
CPC ..... *C22C 1/02* (2013.01); *B22D 1/00* (2013.01); *B22D 18/06* (2013.01); *B22D 21/022* (2013.01);
(Continued)

(58) Field of Classification Search
None
See application file for complete search history.

(56) References Cited

U.S. PATENT DOCUMENTS 5,288,344 A 2/1994 Peker et al.
5,567,532 A * 10/1996 Peker ..... B22D 19/14 420/417
(Continued)

FOREIGN PATENT DOCUMENTS

CN 1122148 A 5/1996
CN 1475595 A 2/2004
(Continued)

OTHER PUBLICATIONS

International Search Report to PCT/CN2013/090294 dated Mar. 20, 2014, (12p).

*Primary Examiner* — George Wyszomierski
(74) *Attorney, Agent, or Firm* — Brinks Gilson & Lione; Yuezhong Feng

(57) ABSTRACT

An amorphous alloy and a method for preparing the amorphous alloy are provided. The amorphous alloy is represented by a formula of $(Zr,Hf)_aM_bN_cBe_d$. M contains at least one element selected from transition group elements. N contains at least one selected from Al and Ti. And $40 \le a \le 70$, $10 \le b \le 40$, $5 \le c \le 20$, $5 \le d \le 25$, and $a+b+c+d=100$. The ratio of an atomic percentage of Hf to an atomic percentage of Zr is in a range of about 0.01 to about 5.

10 Claims, 1 Drawing Sheet

(51) Int. Cl.

| | |
|---|---|
| ***B22D 21/02*** | (2006.01) |
| ***B22D 18/06*** | (2006.01) |
| ***B22D 25/06*** | (2006.01) |
| ***B22D 1/00*** | (2006.01) |
| ***C22C 1/00*** | (2006.01) |
| ***C22C 1/03*** | (2006.01) |

(52) U.S. Cl.
CPC ..... *B22D 25/06* (2013.01); *C22C 1/002* (2013.01); *C22C 1/03* (2013.01); *C22C 45/10* (2013.01)

(56) References Cited

U.S. PATENT DOCUMENTS 7,575,040 B2 * 8/2009 Johnson ..... B22D 11/001 164/423
7,998,286 B2 * 8/2011 Wiest ..... C22C 45/10 148/403
9,353,428 B2 * 5/2016 Peker ..... C22C 1/002

FOREIGN PATENT DOCUMENTS

| | | | |
|---|---|---|---|
| CN | 101152822 | A | 4/2008 |
| CN | 101440464 | A | 5/2009 |
| CN | 101440465 | A | 5/2009 |
| CN | 101451223 | A | 6/2009 |
| CN | 101570837 | A | 11/2009 |
| CN | 101451223 | B | 8/2010 |
| CN | 101440465 | B | 11/2010 |
| CN | 101906598 | A | 12/2010 |
| CN | 102154596 | A | 8/2011 |
| EP | 2065478 | A1 | 6/2009 |
| WO | WO 2007/105738 | A1 | 9/2007 |
| WO | WO 2010/130199 | A1 | 11/2010 |
| WO | WO 2011/050695 | A1 | 5/2011 |
| WO | WO 2011/057552 | A1 | 5/2011 |

* cited by examiner

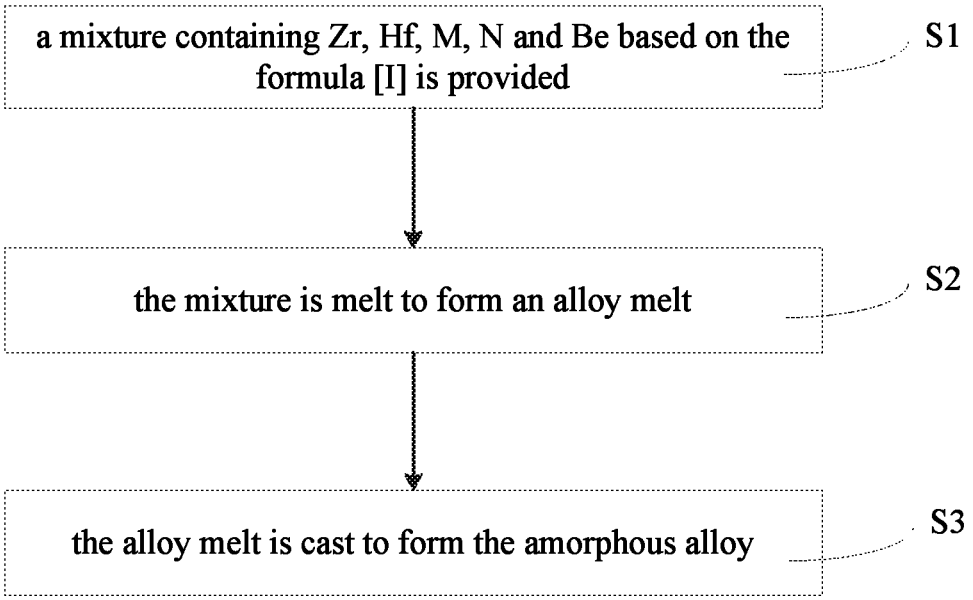
a mixture containing Zr, Hf, M, N and Be based on the formula [I] is provided
S1
the mixture is melt to form an alloy melt
S2
the alloy melt is cast to form the amorphous alloy
S3

AMORPHOUS ALLOY AND METHOD FOR PREPARING THE SAME

CROSS-REFERENCE TO RELATED APPLICATION

This application is the national phase application of PCT Application No. PCT/CN2013/090294, filed Dec. 24, 2013, which claims priority to and benefits of Chinese Patent Application No. 201210592381.8, filed with the State Intellectual Property Office of P. R. China on Dec. 31, 2012, the entire content of both of which is incorporated herein by reference.

FIELD

The present disclosure relates generally to amorphous alloys, and methods for preparing the same.

BACKGROUND

Currently, amorphous alloys normally contain a large amount of active metals, such as Ti, Al and Mg. Therefore, high energy fragments generated from the unexpected collision or friction during the use of the amorphous alloys may cause sparks. Although those sparks have small power, they are greatly restricted in some special process conditions, for example, mining industry, explosion-proof tools industry, etc. Thus, the application of the amorphous alloy is significantly limited.

SUMMARY

Embodiments of the present disclosure seek to solve at least one of the problems existing in the prior art to at least some extent, or to provide a consumer with a useful commercial choice.

In one aspect of the present disclosure, an amorphous alloy is provided. The amorphous alloy may be represented by a formula [I]: $(Zr,Hf)_aM_bN_cBe_d$ [I]. M may contain at least one element selected from transition group elements; N may contain Al or Ti; $40 \le a \le 70$, $10 \le b \le 40$, $5 \le c \le 20$, $5 \le d \le 25$, and $a+b+c+d=100$. A ratio of an atomic percentage of Hf to an atomic percentage of Zr may be in a range of about 0.01 to about 5.

The amorphous alloy according to embodiments of the present disclosure contains Be and Hf, and sparks generated from the collision or friction during the use of the amorphous alloy may be significantly reduced or even eliminated. Therefore the amorphous alloy according to embodiments of the present disclosure may be applied in dangerous fields, such as in an inflammable and explosive environment. In addition, the amorphous alloy according to embodiments of the present disclosure may be low in cost and easy to manufacture.

In another aspect of present disclosure, a method for preparing an amorphous alloy is provided. The amorphous alloy may be represented by a formula [I]: $(Zr,Hf)_aM_bN_cBe_d$ [I]. M may contain at least one element selected from transition group elements; N may contain Al or Ti; $40 \le a \le 70$, $10 \le b \le 40$, $5 \le c \le 20$, $5 \le d \le 25$, and $a+b+c+d=100$. A ratio of an atomic percentage of Hf to an atomic percentage of Zr may be in a range of about 0.01 to about 5. The method may include steps of: providing a mixture containing Zr, Hf, M, N and Be based on the formula [I], and melting and casting the mixture.

With the method according to embodiments of the present disclosure, Be and Hf may be provided into the amorphous alloy. Therefore the sparks generated from collision or friction during the use of the amorphous alloy may be significantly reduced or eliminated. In this way, the amorphous alloy prepared according to embodiments of the present disclosure may be used even in an inflammable and explosive environment. In addition, the method according to embodiments of the present disclosure may be low in cost and easy to operate, and convenient for applying in large-scale industrial manufacture.

Additional aspects and advantages of embodiments of present disclosure will be given in part in the following descriptions, become apparent in part from the following descriptions, or be learned from the practice of the embodiments of the present disclosure.

BRIEF DESCRIPTION OF THE DRAWINGS

These and other aspects and advantages of the present disclosure will become apparent and more readily appreciated from the following descriptions taken in conjunction with the drawing, in which:

FIG. 1 is a flow chart showing a method for preparing an amorphous alloy according to an embodiment of the present disclosure.

DETAILED DESCRIPTION

Reference will be made in detail to embodiments of the present disclosure. The embodiments described herein with reference to drawings are explanatory, illustrative, and used to generally understand the present disclosure. The embodiments shall not be construed to limit the present disclosure. The same or similar elements and the elements having same or similar functions are denoted by like reference numerals throughout the descriptions.

For the purpose of the present description and of the following claims, the definitions of the numerical ranges always include the extremes unless otherwise specified.

According to an aspect of the present disclosure, an amorphous alloy is provided. The amorphous alloys may be represented by the following formula [I]:

$$(Zr,Hf)_aM_bN_cBe_d \quad [I].$$

In the formula [I], M may contain at least one element selected from transition group elements, N may contain Al (aluminum) or Ti (titanium), $40 \le a \le 70$, $10 \le b \le 40$, $5 \le c \le 20$, $5 \le d \le 25$, and $a+b+c+d=100$.

In embodiments of the present disclosure, a, b, c, and d may indicate atomic percentages of corresponding elements, for example, $40 \le a \le 70$ indicates that the total atomic percentages of Zr and Hf may be in the range of about 40 atm % to about 70 atm %; $10 \le b \le 40$ indicates that the atomic percentage of M may be in the range of about 10 atm % to about 40 atm %; $5 \le c \le 20$ indicates that the atomic percentage of N may be in the range of about 5 atm % to about 20 atm %; and $5 \le d \le 25$ indicates that the atomic percentage of Be may be in the range of about 5 atm % to about 25 atm %.

In some embodiments of present disclosure, the ratio of the atomic percentage of Hf to the atomic percentage of Zr may be in a range of about 0.01 to about 5.

Alternatively, the amorphous alloy may have a formula [II]: $Zr_{a1}Hf_{a2}M_{b1}N_{c1}Be_{d1}$ [II]. M may contain at least one element selected from transition group elements; N may contain at least one selected from Al and T; The values of a1, a2, b1, c1 and d1 may be atomic percentages of corresponding elements, in which 40%≤a1+a2≤70%, 10%≤b1≤40%, 5%≤c1≤20%, 5%≤d1≤25%, and the ratio of a2:a1 is in a range of about 0.01 to about 5.

As well known by those skilled in the art, some small fragments may be generated during collision or friction of a metal containing material. After absorbing a quantity of energy, those small fragments may be subjected to an oxidation-reduction reaction to release energy, thus causing sparks. The energy of the spark depends on the intensity of the collision or friction and inherent properties of the material. In addition, the spark is capable of causing a flame or an explosion, which has greatly limited the application of the material.

The inventors found that a material with a high heat conductivity coefficient, such as copper (Cu), Al, Cu alloy or Al alloy, may be less possible to generate sparks. For the material having high heat conductivity coefficient, the energy generated during collision or friction of the material may be spread out rapidly, and then converted to heat. In this condition, sparks may be rarely formed, or even never formed.

The inventors also found that a material with a low hardness, such as copper (Cu), Al, Cu alloy or Al alloy, may be less possible to generate sparks. For the material having high heat conductivity coefficient, the energy generated during collision or friction of the material may be absorbed by a plastic deformation of the material. In this condition, sparks may be rarely formed, or even never formed.

The amorphous alloy according to embodiments of the present disclosure contains beryllium (Be) and hafnium (Hf), and sparks generated from the collision or friction during the use of a conventional amorphous alloy may be significantly reduced or even eliminated. Therefore the amorphous alloy according to embodiments of the present disclosure may be applied in dangerous fields, such as in an inflammable and explosive environment. In addition, the amorphous alloy according to embodiments of the present disclosure may be low in cost and easy to manufacture.

The inventors further found that, if the atomic percentages of Be and Hf are out of the range limited in the formula [I] or [II], the sparks may not be efficiently reduced or eliminated. Moreover, glass forming ability of the amorphous alloy may be decreased greatly, which in turn may increase the manufacture cost of the amorphous alloy. On the contrary, the amorphous alloy according to embodiments of the present disclosure may have good glass forming ability, low in cost, and easy to manufacture.

In some embodiments of present disclosure, M may contain at least one selected from the group consisting of Cu, nickel (Ni), cobalt (Co), iron (Fe), manganese (Mn), yttrium (Y), niobium (Nb), silver (Ag) and titanium (Ti). Then the properties of the amorphous alloy may be further improved.

In some embodiments of present disclosure, the amorphous alloy may contain impurities, and the impurity may have an atomic percentage of lower than 2%.

According to another aspect of the present disclosure, a method for preparing the amorphous alloy mentioned above is provided.

According to embodiments of present disclosure, the method may include steps of: providing a mixture containing Zr, Hf, M, N and Be based on the formula [I], and melting and casting the mixture.

In one embodiment, referring to FIG. 1, the method may include the following steps:

In step S1: a mixture containing Zr, Hf, M, N and Be based on the formula [I] is provided.

In step S2: the mixture is melt to form an alloy melt; and

In step S3: the alloy melt is cast to form the amorphous alloy.

The steps of the method will be described in details in the following.

Mixing

In the step S1, a mixture containing Zr, Hf, M, N and Be are provided. In one embodiment, at least one Zr containing material, at least one Hf containing material, at least one M containing material, at least one N containing material and at least one Be containing material are mixed to form the mixture. The contents of the Zr containing material, Hf containing material, M containing material, N containing material and Be containing material are provided according to the formula [I]. In other words, in the formula [I], the values of a, b, c and d indicates the atomic percentages of the corresponding elements, the amounts of the elements chosen to be mixed should meet the requirements of the formula [I].

According to some embodiments of present disclosure, Zr, Hf, M, N and Be may be provided in various forms, for example, in forms of pure metals or alloys.

In some embodiments of present disclosure, the Be is provided into the mixture in a form of an intermediate alloy, and the intermediate alloy includes at least one of BeNi alloy and BeCu alloy. It is known that, element Be is highly active, introducing Be into the mixture in the form of the intermediate alloy may facilitate the following melting step. Thus, the method according to embodiments of the present disclosure may be more convenient to operate.

Melting

In this step, the resulting mixture of the mixing step is melt to form an alloy melt.

In some embodiments of present disclosure, the melting is performed under vacuum. Then, the elements introduced to the alloy will not react with undesirable elements, such as oxygen. Then the properties of the resulting amorphous alloy may be further improved.

In an embodiment, the melting is performed under vacuum with a vacuum degree of lower than about 100 Pa. In this way, properties, like anti-spark performances, of the resulting amorphous alloy may be further improved.

In some embodiments of present disclosure, the melting is performed in the presence of an inert gas. Then the properties of the resulting amorphous alloy may be further improved. In one embodiment, the inert gas may be argon.

Casting

In this step, the alloy melt obtained in the previous melting step is cast to form the amorphous alloy. There are no particular limitations for methods of casting in the present disclosure, and the casting step may be carried out by employing any commonly used casting processes known by those skilled in the art. In some embodiments of present disclosure, the casting step may be carried out by suction casting, without particular limits. Then the properties of the resulting amorphous alloy may be further improved.

The present disclosure will be described in details with reference to the following examples.

Example 1

A mixture containing metal Zr (having a purity larger than 99.9%), metal Hf (having a purity larger than 99%), AlNb alloy, metal Cu (having a purity larger than 99%), metal Ni (having a purity larger than 99%), metal Al (having a purity larger than 99%), BeNi alloy and BeCu alloy was formed, and contents of corresponding elements was determined according to the formula $(Zr_{57}Hf_1Nb_5Cu_{14.4}Ni_{12.6}Al_{10})_{94}Be_6$. Then the mixture was melted in a vacuum melting furnace for 15 minutes in the presence of argon (99.99%) at 1000 Celsius degrees, to form an alloy melt. Then the alloy melt was cast into an amorphous alloy in a metal mould.

The melting temperature during the melting step was measured by an infrared thermometer.

Testing samples of the amorphous alloy were prepared and tested according to JB/T 8313-1996 (Standard of mechanical industry). The testing samples were tested with a rotating disk experiment, in which 16000 times of rotating collision were performed and a gas mixture containing methane ($CH_4$, 5.5%-6.5%) and air was applied. The sparking times that the gas mixture was sparked were recorded.

The results are shown in Table 1.

Example 2

A mixture containing metal Zr (having a purity larger than 99.9%), metal Hf (having a purity larger than 99%), AlNb alloy, metal Cu (having a purity larger than 99%), metal Ni (having a purity larger than 99%), metal Al (having a purity larger than 99%), BeNi alloy and BeCu alloy was formed, and contents of corresponding elements was determined according to the formula $(Zr_{57}Hf_1Nb_5Cu_{14.4}Ni_{12.6}Al_{10})_{85}Be_{15}$. Then the mixture was melted in a vacuum melting furnace for 15 minutes in the presence of argon (99.99%) at 1000 Celsius degrees to form an alloy melt. Then the alloy melt was cast into an amorphous alloy in a metal mould.

The melting temperature during the melting step was measured by an infrared thermometer.

Testing samples of the amorphous alloy were prepared and tested according to JB/T 8313-1996 (Standard of mechanical industry). The testing samples were tested with a rotating disk experiment, in which 16000 times of rotating collision were performed and a gas mixture containing $CH_4$ (5.5%-6.5%) and air was applied. The sparking times were recorded.

The results are shown in Table 1.

Example 3

A mixture containing of metal Zr (having a purity larger than 99.9%), metal Hf (having a purity larger than 99%), metal Cu (having a purity larger than 99%), metal Al (having a purity larger than 99%), metal Ni (having a purity larger than 99%), BeNi alloy and BeCu alloy was formed, and contents of corresponding elements was determined according to the formula $(Zr_{65}Hf_{0.6}Cu_{14.4}Al_{10}Ni_{10})_{90}Be_{10}$. Then the mixture was melted in a vacuum melting furnace for 15 minutes in the presence of argon (99.99%) at 1000 Celsius degrees to form an alloy melt. Then the alloy melt was cast into an amorphous alloy in a metal mould.

The melting temperature during the melting step was measured by an infrared thermometer.

Testing samples of the amorphous alloy were prepared and tested according to JB/T 8313-1996 (Standard of mechanical industry). The testing samples were tested with a rotating disk experiment, in which 16000 times of rotating collision were performed and a gas mixture containing $CH_4$ (5.5%-6.5%) and air was applied. The sparking times were recorded.

The results are shown in Table 1.

Example 4

A mixture containing metal Zr (having a purity larger than 99.4%, and the metal Zr was provided in a form of a metal mixture containing Zr and Hf), metal Hf (having a purity larger than 99%), metal Cu (having a purity larger than 99%), metal Ti (having a purity larger than 99%), metal Co (having a purity larger than 99%), metal Al (having a purity larger than 99%), metal Ni (having a purity larger than 99%), BeNi alloy and BeCu alloy was formed, and contents of corresponding elements was determined according to the formula $(Zr_{63}Hf_2Cu_{12}Ti_2Co_1Al_{10}Ni_{10})_{90}Be_{10}$. Then the mixture was melted in a vacuum melting furnace for 15 minutes in the presence of argon (99.99%) at 1000 Celsius degrees to form an alloy melt. Then the alloy melt was cast into an amorphous alloy in a metal mould.

The melting temperature during the melting step was measured by an infrared thermometer.

Testing samples of the amorphous alloy were prepared and tested according to JB/T 8313-1996 (Standard of mechanical industry). The testing samples were tested with a rotating disk experiment, in which 16000 times of rotating collision were performed and a gas mixture containing $CH_4$ (5.5%-6.5%) and air was applied. The sparking times were recorded.

The results are shown in Table 1.

Comparative Example 1

A mixture containing metal Zr (having a purity larger than 99.9%), metal Hf (having a purity larger than 99%), AlNb alloy (having a purity larger than 99%), metal Cu (having a purity larger than 99%), metal Ni (having a purity larger than 99%) and metal Al (having a purity larger than 99%) was formed, and contents of corresponding elements was determined according to the formula $Zr_{57}Hf_1Nb_5Cu_{14.4}Ni_{12.6}Al_{10}$. Then the mixture was melted in a vacuum melting furnace for 15 minutes in the presence of argon (99.99%) at 1000 Celsius degrees to form an alloy melt. Then the alloy melt was cast into an amorphous alloy in a metal mould.

The melting temperature during the melting step was measured by an infrared thermometer.

Testing samples of the amorphous alloy were prepared and tested according to JB/T 8313-1996 (Standard of mechanical industry). The testing samples were tested with a rotating disk experiment, in which 16000 times of rotating collision were performed and a gas mixture containing $CH_4$ (5.5%-6.5%) and air was applied. The sparking times were recorded.

The results are shown in Table 1.

Comparative Example 2

A mixture containing metal Zr (having a purity larger than 99.9%), metal Cu (having a purity larger than 99%), metal Al (having a purity larger than 99%) and metal Ni (having a purity larger than 99%) was formed, and contents of corresponding elements was determined according to the formula $Zr_{65}Cu_{15}Al_{10}Ni_{10}$. Then the mixture was melted in a vacuum melting furnace for 15 minutes in the presence of argon (99.99%) at 1000 Celsius degrees to form an alloy melt. Then the alloy melt was cast into an amorphous alloy in a metal mould.

The melting temperature during the melting step was measured by an infrared thermometer.

Testing samples of the amorphous alloy were prepared and tested according to JB/T 8313-1996 (Standard of mechanical industry). The testing samples were tested with a rotating disk experiment, in which 16000 times of rotating collision were performed and a gas mixture containing $CH_4$ (5.5%-6.5%) and air was applied. The sparking times were recorded.

The results are shown in Table 1.

Comparative Example 3

A mixture containing metal Zr (having a purity larger than 99.9%), metal Hf (having a purity larger than 99%), AlNb alloy (having a purity larger than 99%), metal Cu (having a purity larger than 99%), metal Ni (having a purity larger than 99%), metal Al (having a purity larger than 99%) and metal Be (having a purity larger than 99%) was formed, and contents of corresponding elements was determined according to the formula $(Zr_{57}Hf_3Nb_5Cu_{12.4}Ni_{12.6}Al_{10})_{97}Be_3$. Then the mixture was melted in a vacuum melting furnace for 15 minutes in the presence of argon (99.99%) at 1000 Celsius degrees to form an alloy melt. Then the alloy melt was cast into an amorphous alloy in a metal mould.

The melting temperature during the melting step was measured by an infrared thermometer.

Testing samples of the amorphous alloy were prepared and tested according to JB/T 8313-1996 (Standard of mechanical industry). The testing samples were tested with a rotating disk experiment, in which 16000 times of rotating collision were performed and a gas mixture containing $CH_4$ (5.5%-6.5%) and air was applied. The sparking times were recorded.

The results are shown in Table 1.

Comparative Example 4

A mixture containing metal Zr (having a purity larger than 99.9%), metal Cu (having a purity larger than 99%), metal Ti (having a purity larger than 99%), metal Al (having a purity larger than 99%), metal Ni (having a purity larger than 99%) and metal Be (having a purity larger than 99%) was formed, and contents of corresponding elements was determined according to the formula $(Zr_{63}Cu_{12}Ti_2Co_1Al_{10}Ni_{10})_{90}Be_{10}$. Then the mixture was melted in a vacuum melting furnace for 15 minutes in the presence of argon (99.99%) at 1000 Celsius degrees to form an alloy melt. Then the alloy melt was cast into an amorphous alloy in a metal mould.

The melting temperature during the melting step was measured by an infrared thermometer.

Testing samples of the amorphous alloy were prepared and tested according to JB/T 8313-1996 (Standard of mechanical industry). The testing samples were tested with a rotating disk experiment, in which 16000 times of rotating collision were performed and a gas mixture containing $CH_4$ (5.5%-6.5%) and air was applied. The sparking times were recorded.

The results are shown in Table 1.

TABLE 1

| Example | Composition | Sparking Times |
|---|---|---|
| Example 1 | $(Zr_{57}Hf_1Nb_5Cu_{14.4}Ni_{12.6}Al_{10})_{94}Be_6$ | 10 |
| Example 2 | $(Zr_{57}Hf_1Nb_5Cu_{14.4}Ni_{12.6}Al_{10})_{85}Be_{15}$ | 5 |
| Example 3 | $(Zr_{65}Hf_{0.6}Cu_{14.4}Al_{10}Ni_{10})_{90}Be_{10}$ | 8 |
| Example 4 | $(Zr_{63}Hf_2Cu_{12}Ti_2Co_1Al_{10}Ni_{10})_{90}Be_{10}$ | 9 |
| Comparative Example 1 | $Zr_{57}Hf_1Nb_5Cu_{14.4}Ni_{12.6}Al_{10}$ | 100 |
| Comparative Example 2 | $Zr_{65}Cu_{15}Al_{10}Ni_{10}$ | 150 |
| Comparative Example 3 | $(Zr_{57}Hf_3Nb_5Cu_{12.4}Ni_{12.6}Al_{10})_{97}Be_3$ | 85 |
| Comparative Example 4 | $(Zr_{63}Cu_{12}Ti_2Co_1Al_{10}Ni_{10})_{90}Be_{10}$ | 20 |

As indicated in Table 1, the sparking times of amorphous alloys in Examples 1-4 (the amorphous alloys according to the present disclosure) are obviously lower than those in Comparative Examples 1-4. According to JB/T 8313-1996, the less the sparking time is, the safer the tested sample is. It can be concluded that, the amorphous alloy according to embodiments of the present disclosure has less sparking time and is safer for use.

Especially, as shown in Table 1, amorphous alloys in Examples 2 and 3 exhibit sparking times of 5 and 8 respectively. And in this condition, those amorphous alloys prepared by the method according to embodiments of the present disclosure may be used in specific devices, such as explosion-proof electric devices of type I and type II.

It is obvious in the Table 1 that, sparking times of the amorphous alloys in the comparative examples 1 and 2 are greatly higher than those in examples of the present disclosure. In the comparative example 3, a small quantity of Be was introduced in the amorphous alloy. Although the sparking time of the amorphous alloy in the comparative example 3 is reduced, it is still higher than those amorphous alloys in the examples of the present disclosure.

Although explanatory embodiments have been shown and described, it would be appreciated by those skilled in the art that changes, alternatives, and modifications can be made in the embodiments without departing from spirit and principles of the disclosure. Such changes, alternatives, and modifications all fall into the scope of the claims and their equivalents.

What is claimed is:

1. An amorphous alloy represented by formula [I]:

$$(Zr,Hf)_aM_bN_cBe_d \quad [I]$$

wherein

M comprises at least one element selected from transition group elements;

N is Al;

$40 \le a \le 70$, $10 \le b \le 40$, $5 \le c \le 20$, $5 \le d \le 25$, $a+b+c+d=100$; and a ratio of an atomic percentage of Hf to an atomic percentage of Zr is in a range of about 0.01 to about 0.032.

2. The amorphous alloy according to claim 1, wherein M comprises at least one selected from the group consisting of Cu, Ni, Co, Fe, Mn, Y, Nb, Ag and Ti.

3. The amorphous alloy according to claim 1, wherein the amorphous alloy comprises an impurity, and the impurity has an atomic percentage of lower than 2%.

4. The amorphous alloy according to claim 1, wherein $49.3 \le a \le 70$.

5. The amorphous alloy according to claim 4, wherein $5 \le d \le 15$.

6. The amorphous alloy according to claim 4, wherein either an atomic percentage of Hf equals or less than about 1.8, or an atomic percentage of Zr equals or more than about 48.45.

7. The amorphous alloy according to claim 4, which is $(Zr_{57}Hf_1Nb_5Cu_{14.4}Ni_{12.6}Al_{10})_{94}Be_6$.

8. The amorphous alloy according to claim 4, which is $(Zr_{57}Hf_1Nb_5Cu_{14.4}Ni_{12.6}Al_{10})_{85}Be_{15}$.

9. The amorphous alloy according to claim 4, which is $(Zr_{63}Hf_2Cu_{12}Ti_2Co_1Al_{10}Ni_{10})_{90}Be_{10}$.

10. An amorphous alloy having the formula $(Zr_{65}Hf_{0.6}Cu_{14.4}Al_{10}Ni_{10})_{90}Be_{10}$.

* * * * *